US010401896B1

(12) United States Patent
Kim et al.

(10) Patent No.: US 10,401,896 B1
(45) Date of Patent: Sep. 3, 2019

(54) PEDAL FOR VEHICLE CAPABLE OF ADJUSTING PEDAL EFFORT BY USE OF DETENT

(71) Applicants: Hyundai Motor Company, Seoul (KR); Kia Motors Corporation, Seoul (KR)

(72) Inventors: Woo-Duck Kim, Gyeonggi-Do (KR); Mi-Yeong Kim, Gyeonggi-Do (KR); Min-Seong Park, Daegu (KR); Bo-Hee Ku, Daegu (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 0 days.

(21) Appl. No.: 16/166,371

(22) Filed: Oct. 22, 2018

(30) Foreign Application Priority Data

Apr. 3, 2018 (KR) ..... 10-2018-0038689

(51) Int. Cl.

| | |
|---|---|
| ***G05G 5/03*** | (2008.04) |
| ***G05G 1/30*** | (2008.04) |
| ***G05G 1/44*** | (2008.04) |
| ***G05G 5/04*** | (2006.01) |

(52) U.S. Cl.
CPC ..... *G05G 5/03* (2013.01); *G05G 1/44* (2013.01); *G05G 5/04* (2013.01); *G05G 2700/14* (2013.01); *G05G 2700/18* (2013.01)

(58) Field of Classification Search
CPC .. G05G 1/30; G05G 1/38; G05G 1/44; G05G 1/445; G05G 1/46; G05G 5/03; G05G 5/04; G05G 5/05; G05G 2700/14; G05G 2700/18
See application file for complete search history.

(56) References Cited

U.S. PATENT DOCUMENTS

| | | | | |
|---|---|---|---|---|
| 6,330,838 | B1 * | 12/2001 | Kalsi | B60K 26/02 200/61.89 |
| 6,658,963 | B2 * | 12/2003 | Yaddehige | G05G 1/30 74/473.16 |
| 6,860,170 | B2 * | 3/2005 | DeForest | G05G 1/30 74/512 |
| 9,260,088 | B2 * | 2/2016 | Shand | B60T 7/042 |
| 9,632,525 | B2 * | 4/2017 | Kaijala | G05G 25/04 |

(Continued)

FOREIGN PATENT DOCUMENTS

| | | | | |
|---|---|---|---|---|
| DE | 4301229 | C1 * | 12/1993 | B60K 23/02 |
| DE | 19630156 | A1 * | 1/1998 | B60K 26/021 |

(Continued)

OTHER PUBLICATIONS

Translation of DE 19630156 A1 obtained on Jan. 28, 2019.*

*Primary Examiner* — Adam D Rogers
(74) *Attorney, Agent, or Firm* — Mintz Levin Cohn Ferris Glovsky and Popeo, P.C.; Peter F. Corless

(57) ABSTRACT

A pedal includes a pedal effort adjuster configured to generate pedal effort in response to an increase in stroke of a pedal arm, where the pedal effort adjuster includes a detent spring for generating the pedal effort by load of the detent spring that is decreased after being increased in response to a change in reaction force caused by the increase in stroke and a return spring for generating the pedal effort by load of the return spring that is increased by maintaining reaction force caused by the increase in stroke.

13 Claims, 10 Drawing Sheets

(56) References Cited

U.S. PATENT DOCUMENTS

| | | | |
|---|---|---|---|
| 2007/0289402 | A1 | 12/2007 | La et al. |
| 2015/0192076 | A1 | 7/2015 | Jordan |
| 2016/0107625 | A1 | 4/2016 | Shand et al. |

FOREIGN PATENT DOCUMENTS

| | | | | |
|---|---|---|---|---|
| FR | 2997045 | A1 * | 4/2014 | ..... B60K 23/02 |
| JP | H 05-79618 | | 10/1993 | |
| JP | 2536953 | Y2 | 5/1997 | |
| JP | 2012-020727 | A | 2/2012 | |
| JP | 2013-015125 | A | 1/2013 | |
| KR | 1998-061139 | A | 4/2000 | |
| KR | 10-2008-0040870 | A | 5/2008 | |
| KR | 10-0892479 | B1 | 4/2009 | |
| KR | 10-1276079 | B1 | 6/2013 | |
| WO | 2014/048661 | A1 | 4/2014 | |

* cited by examiner

PEDAL FOR VEHICLE CAPABLE OF ADJUSTING PEDAL EFFORT BY USE OF DETENT

CROSS-REFERENCE TO RELATED APPLICATION(S)

This application claims under 35 U.S.C. § 119(a) the benefit of Korean Patent Application No. 10-2018-0038689, filed on Apr. 3, 2018, the entire contents of which are incorporated herein by reference.

BACKGROUND

(a) Technical Field

The present disclosure relates to a pedal for a vehicle, more particularly, to the pedal of which pedal operation feedback is generated by pedal effort caused by use of a detent structure.

(b) Description of the Related Art

In general, eco-friendly vehicles require generation of pedal effort that can be felt by a driver when the driver operates a pedal because it adopts a brake-by-wire (BBW) system and an electronic clutch system.

For example, in the electronic clutch system, since operation of an actuator is performed by a signal for the pedal, it is difficult for the driver to receive feedback in response to operation of the pedal, which requires generation of pedal effort.

However, in a conventional pedal control system, in order to develop an electronic clutch system which is a technology for enhancing fuel efficiency during actual driving conditions by automatically cutting off engine power and reducing engine resist during coasting running by a manual transmission, it is necessary to develop an electronic clutch pedal that is capable of substituting pedal effort generated by hydraulic force of the existing clutch system.

In addition, an apparatus for generating pedal effort is required to have a capability of freely changing the pedal effort, which is problematic in that manufacturing cost is significantly increased because expensive magnetic fluid and many sensors must be used therefor, where the magnetic fluid may be subject to demagnetization and hence magnetic force is reduced over time.

Further, since types of engines and specifications of vehicles are different for each vehicle type, those actuating mechanisms are not unified and vary depending on the type of vehicle, which causes the manufacturing cost to increase. Therefore, it has been required to develop a new, unified driving system.

SUMMARY

The present disclosure provides a pedal for a vehicle capable of adjusting pedal effort by use of a detent structure, which is capable of enhancing pedal maneuverability by increasing pedal effort and hump so as to satisfy a driver's requirement and of providing a driver with optimal feedback during operation with a simple structure, thereby implementing pedal effort.

Other objects and advantages of the present disclosure can be understood by the following description, and become apparent with reference to the embodiments of the present disclosure. Also, it is obvious to those skilled in the art to which the present disclosure pertains that the objects and advantages of the present disclosure can be realized by the means as claimed and combinations thereof.

In accordance with one aspect of the present disclosure, there is provided a pedal comprising a pedal effort adjuster configured to generate pedal effort in response to an increase in stroke of a pedal arm, wherein the pedal effort adjuster further comprises a detent spring for generating the pedal effort by load of the detent spring that is decreased after being increased in response to a change in reaction force caused by the increase in stroke; and a return spring for generating the pedal effort by load of the return spring that is increased by maintaining reaction force caused by the increase in stroke.

The reaction force of the detent spring may be changed by a piston.

The detent spring may be installed within the pedal arm.

The piston may have a round shape at its outside end.

The piston may be configured to be inserted into one end of the pedal arm and coupled thereto in a protruding state.

The piston contacts with a guide inner surface of a guide rail, and the guide inner surface of the guide rail is capable of changing a height of the piston.

The guide inner surface of the guide rail may divide a contact movement path of the piston into a plurality of paths to make the change in reaction force.

The guide inner surface of the guide rail may be configured such that the contact movement path is formed in a straight line.

The guide inner surface of the guide rail may be configured such that the contact movement path is formed in a curved form.

The guide inner surface of the guide rail may be configured such that the contact movement path is formed in a circular arc shape.

The pedal arm may be rotatably coupled to a main member, wherein the main member may be of a structure to which the guide inner surface of the guide rail for changing a height of the piston is coupled and which is covered and concealed with a cover.

The main member and the guide rail may be formed in a close-contact surface structure.

The main member and the guide rail may be connected to each other via coupling protrusions.

The main member and the cover are connected-to each other via protrusions

The pedal arm may have a curved shape.

The pedal arm may have a bushing at a central portion thereof.

The piston may have a round shape at its outside end.

The inner surface of the guide rail may be divided into a plurality of guide inner surfaces.

The cover may be formed with protrusions coupled to the main member.

In accordance with another aspect of the present disclosure, the pedal effort adjuster is configured such that when the pedal is depressed, a first pedal effort is generated by the return spring and a second pedal effort is increased or decreased by the detent spring.

The clutch pedal effort can be generated by the first and second pedal efforts.

The pedal effort generated by the pedal in the pedal effort adjuster of the pedal can be calculated using the equation 1 as follows:

$$F_p = \frac{L_3 \cdot F_{s1} + L_4 \cdot F_{s2}}{L_1} \quad \text{Equation 1}$$

where $L_1$ represents distance from a center of a hinge of the pedal arm to a center of a pad of the pedal arm, $L_3$ represents distance from a center of a hinge of the pedal arm to a center of a spring $F_{s1}$, $L_4$ represents distance from a center of a hinge of the pedal arm to a contact portion of the guide inner surface of the guide rail along a pedal stroke, $F_{s1}$ represents force applied in a direction perpendicular to $L_3$, and $F_{s2}$ represents force applied in a direction perpendicular to $L_4$.

According to one embodiment of the present disclosure, since generation of pedal effort by use of a pedal effort adjuster of a pedal is implemented by constituting a guide inner surface of a guide rail in a type of assembling in the main member, it is possible to meet various requirements of drivers by simply replacing the guide inner surface of the guide rail, maneuverability can be further enhanced by increasing the peak of the guide inner surface, and pedal effort can be implemented with the minimum layout by virtue of a simple structure.

It is to be understood that both the foregoing general description and the following detailed description of the present disclosure are exemplary and explanatory and are intended to provide further explanation of the disclosure as claimed.

BRIEF DESCRIPTION OF THE DRAWINGS

The above and other objects, features and other advantages of the present disclosure will be more clearly understood from the following detailed description taken in conjunction with the accompanying drawings, in which.

DESCRIPTION OF SPECIFIC EMBODIMENTS

Figure 1:
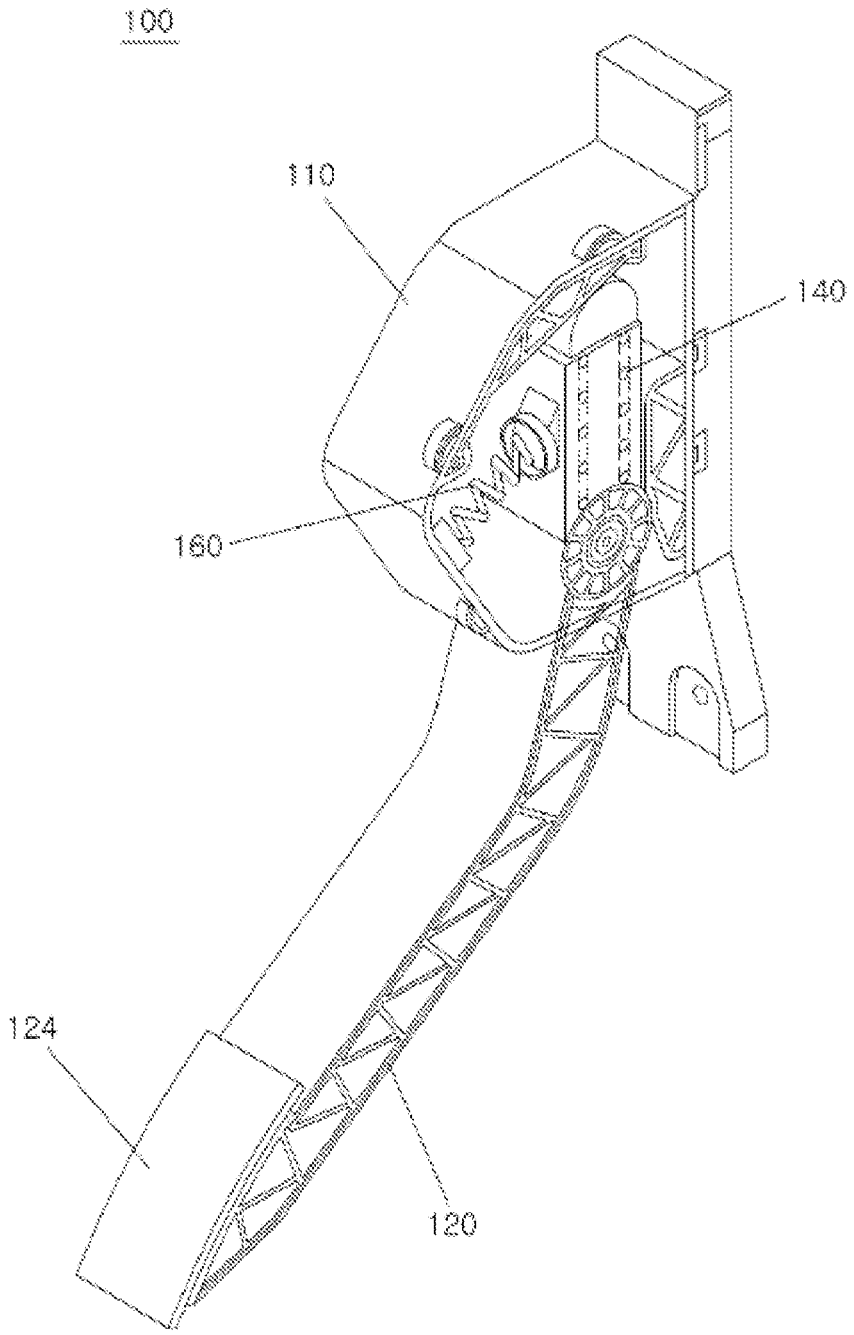
FIG. 1 is a perspective view of a pedal effort adjuster for adjusting detent pedal effort of a pedal according to an embodiment of the present disclosure.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

The terminology used herein is for the purpose of describing particular embodiments only and is not intended to be limiting of the disclosure. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Throughout the specification, unless explicitly described to the contrary, the word "comprise" and variations such as "comprises" or "comprising" will be understood to imply the inclusion of stated elements but not the exclusion of any other elements. In addition, the terms "unit", "-er", "-or", and "module" described in the specification mean units for processing at least one function and operation, and can be implemented by hardware components or software components and combinations thereof.

Further, the control logic of the present disclosure may be embodied as non-transitory computer readable media on a computer readable medium containing executable program instructions executed by a processor, controller or the like. Examples of computer readable media include, but are not limited to, ROM, RAM, compact disc (CD)-ROMs, magnetic tapes, floppy disks, flash drives, smart cards and optical data storage devices. The computer readable medium can also be distributed in network coupled computer systems so that the computer readable media is stored and executed in a distributed fashion, e.g., by a telematics server or a Controller Area Network (CAN).

Embodiments described below are provided in order for those skilled in the art to easily understand the technical spirit of the present disclosure and the present disclosure is not limited thereto. In addition, contents represented in the accompanying drawings are diagrammed in order to easily describe the embodiments of the present disclosure and may be different from configurations actually implemented.

It is to be understood that when a component is referred to as being coupled or connected to the other component, it may be directly coupled or connected to the other component but there may be another component interposed therebetween.

The term "connection" as used herein includes direct connection and indirect connection between a member and another member and may mean all physical connections such as adhesion, attachment, fastening, bonding and coupling.

In addition, the expressions such as "first," "second," etc. are used only to distinguish a plurality of components but not limit the order of the components or other features.

Figure 2:
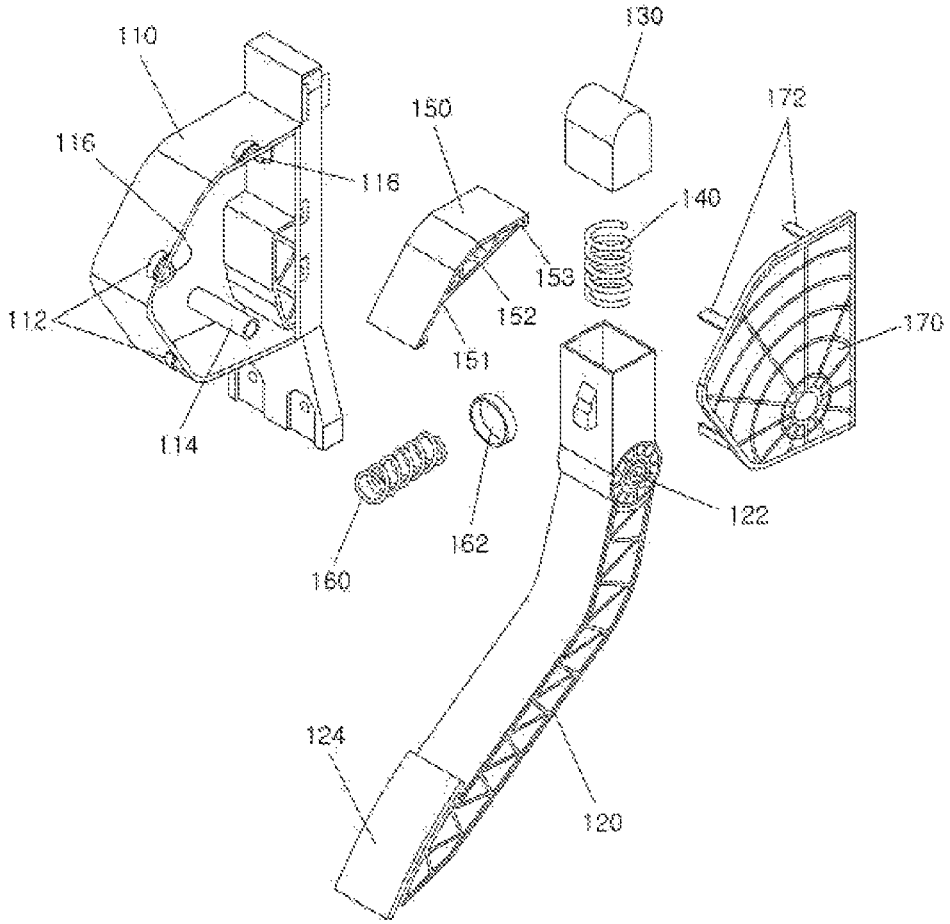
FIG. 2 is an exploded perspective view of a pedal effort adjuster of a pedal according to an embodiment of the present disclosure shown in FIG. 1.
Figure 3:
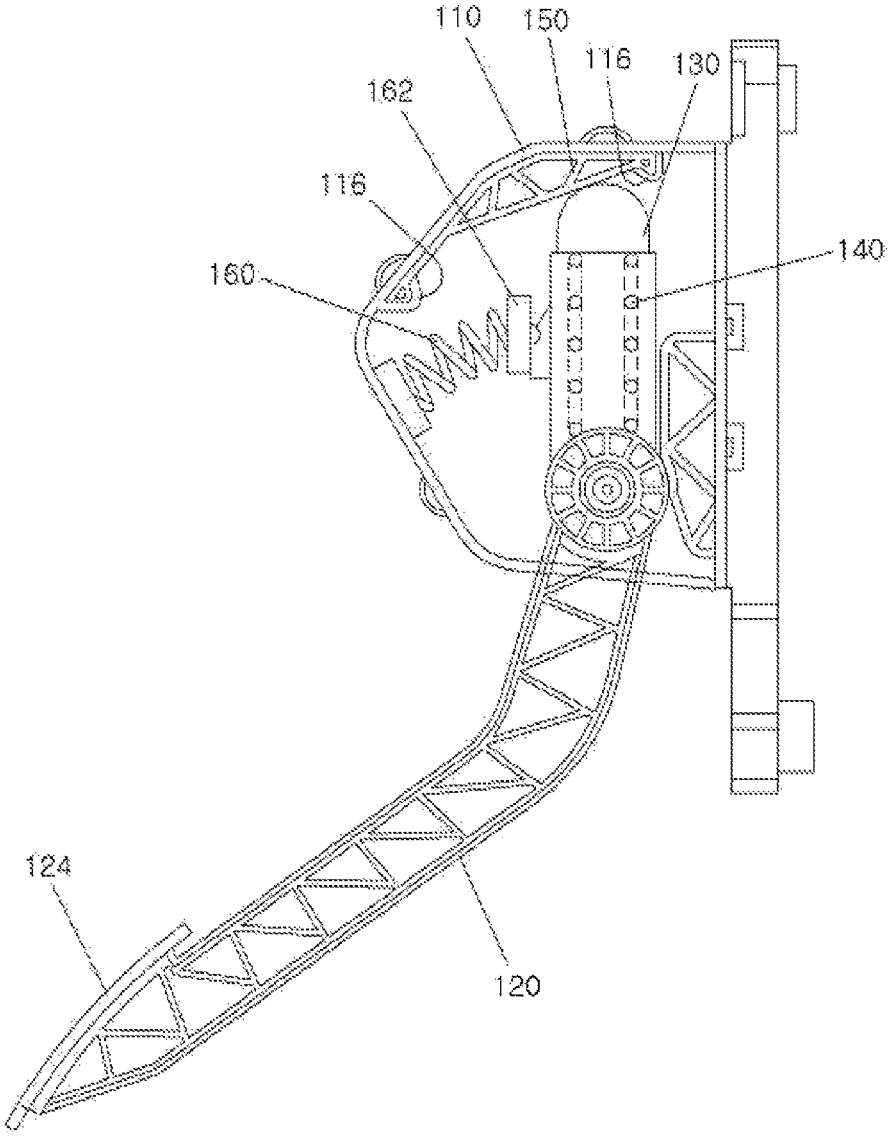
FIG. 3 is a view showing an internal structure of a pedal effort adjuster of a pedal according to an embodiment of the present disclosure shown in FIG. 1.

FIG. 1 is a perspective view of a pedal effort adjuster of a pedal according to an embodiment of the present disclosure, FIG. 2 is an exploded perspective view of a pedal effort adjuster of a pedal according to an embodiment of the present disclosure shown in FIG. 1, and FIG. 3 is a view showing an internal structure of a pedal effort adjuster of a pedal according to an embodiment of the present disclosure shown in FIG. 1.

Hereinafter, although pedal effort of a pedal will be described with reference to a clutch pedal applied to an electronic clutch system, the pedal also includes a brake pedal or an accelerator pedal of which pedal effort is generated by pedal stroke.

Referring to FIGS. 1 to 3, a pedal effort adjuster 100 of a pedal capable of adjusting pedal effort includes a main member 110, a pedal arm 120 rotatably coupled to the main member 110, a piston 130 coupled to one end of the pedal arm 120, a detent spring 140 configured to generate depression force by being compressed by the piston 130, a guide rail 150 coupled to the main member 110 to change a height of the piston 130, a return spring 160 configured to generate depression force in response to operation of the pedal arm 120, and a cover 170 configured to cover the main member 110.

According to an embodiment of the present disclosure, the main member 110 is provided at its outer periphery with fixing portions 112 to be coupled with the cover 170 and a rotation shaft 114 for allowing the pedal arm 120 to rotate about its axis. Particularly, a plurality of fixing portions 112 are formed.

The main member 110 has a close-contact surface structure between it and the outer surface of the guide rail 150 and is formed with coupling protrusions 116 to which the guide rail 150 is fixed. Particularly, a plurality of coupling protrusions 116 are formed.

In one specific example, the pedal arm 120 is of a curved shape and is provided with a bushing 122 at a central portion thereof. One end of the pedal arm 120 extends from the main member 110 and is provided with a pedal arm pad 124. The pedal arm 120 generates reaction force by the return spring 160 wherein the return spring 160 is fixed by the spring seat 162.

In addition, the pedal arm is configured such that the other end of the pedal arm 120 that is opposite to one end having the pedal arm pad 124 has a hollow shape in which the detent spring 140 is mounted and with which the piston 130 is coupled.

In this case, the piston 130 is configured such that its outside end is formed in a round shape, and it is inserted into and coupled with one end of the pedal arm 120. Also, the piston 130 protrudes from said other end of the pedal arm 120. In other words, the round shaped portion of the piston 130 protrudes from said other end of the pedal arm 120.

In one specific example, the inner surface of the guide rail 150 is divided into a plurality of first, second and third guide inner surfaces 151, 152 and 153 wherein although three first, second and third guide inner surfaces 151, 152, and 153 are illustrated in the drawings, the present disclosure is not limited thereto and, if necessary, four or more guide inner surfaces may be formed to provide a more smooth movement path. In this case, the first, second and third guide inner surfaces 151, 152, and 153 are configured such that their inner surfaces to be in contact with the piston 130 are formed in a straight line respectively.

On the other hand, the cover 170 is formed with protrusions 172 to be coupled with the main member 110, i.e., the fixing portions 112 of the main member 110. Particularly, a plurality of protrusions 172 are formed in the same manner as the fixing portions 112.

Figure 4:
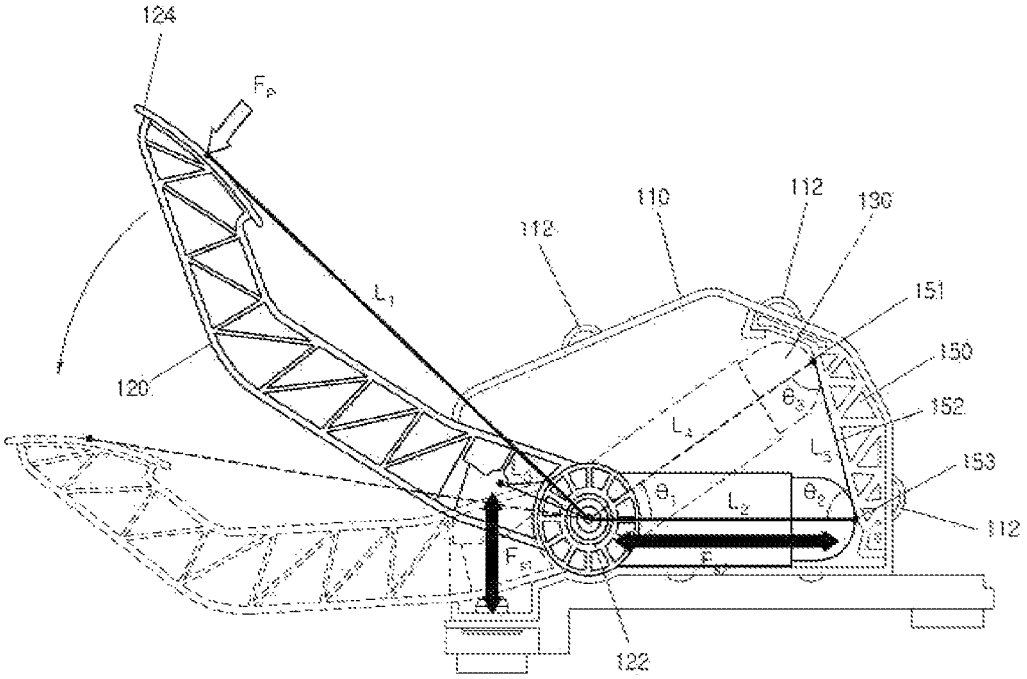
FIG. 4 is a view showing a principle of generating pedal effort in a pedal effort adjuster of a pedal according to an embodiment of the present disclosure.

FIG. 4 is a view showing a principle of generating pedal effort in the pedal effort adjuster of the pedal according to an embodiment of the present disclosure.

Referring to FIG. 4 together with FIGS. 1 to 3, a pedal effort adjuster 100 of a pedal includes a main member 110, a pedal arm 120 rotatably coupled to the main member 110, a piston 130 coupled to one end of the pedal arm 120, a detent spring 140 configured to generate depression force by being compressed by the piston 130, a guide rail 150 coupled to the main member 110 to change a height of the piston 130, a return spring 160 configured to generate depression force in response to operation of the pedal arm 120, and a cover 170 configured to cover the main member 110 wherein clutch pedal effort to be generated by depressing the pedal arm 120 in the pedal effort adjuster 100 of the pedal is calculated using the equation 1 as follows:

$$F_p = \frac{L_3 \cdot F_{s1} + L_4 \cdot F_{s2}}{L_1} \qquad \text{Equation 1}$$

As the pedal arm 120 is operated, pedal effort to be linearly increased by the return spring 160 is generated and pedal effort to be increased by the detent spring 140 and then decreased is generated, with the result that optimum clutch pedal effort desired by a driver is generated by resulting force of the two pedal efforts.

Where factors are defined as follows: $F_p$ represents a pedal effort when a driver depresses the pedal, $F_{s1}$ represents a force applied in a direction perpendicular to $L_3$, and $F_{s2}$ represents a force applied in a direction perpendicular to $L_4$.

In addition, $L_1$ represents a distance from a center of a hinge 122 of the pedal arm 120 to a center of a pad 124 of the pedal arm 120, $L_2$ represents an initial distance from a center of a hinge 122 of the pedal arm 120 to a contact portion of the guide rail 150, $L_3$ represents a distance from a center of a hinge 122 of the pedal arm 120 to a center of a spring $F_{s1}$, $L_4$ represents a distance from a center of a hinge 122 of the pedal arm 120 to a contact portion of the guide inner surface of the guide rail along a pedal stroke, and $L_5$ represents a moving distance of an end of the pedal arm 120 along a pedal stroke.

On the other hand, $\theta_1$ represents an angle at which the pedal arm 120 has moved, $\theta_2$ represents an angle formed between the end of the pedal arm 120 and the guide rail 150 and $\theta_3$ represent an angle formed between the end of the pedal arm 120 and the guide rail 150.

Figure 5:
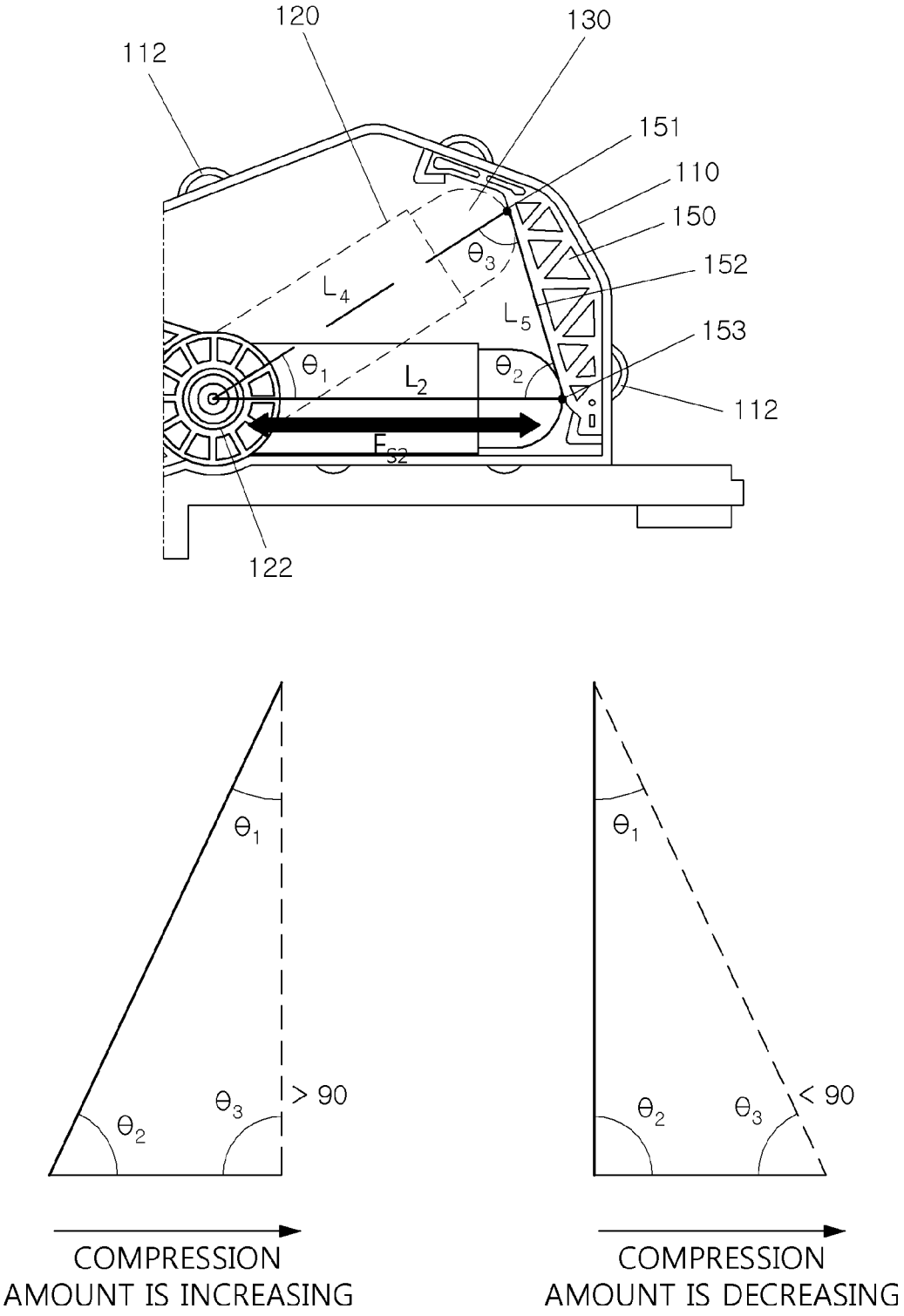
FIG. 5 is a view showing definition of angles of a guide inner surface of a guide rail in a pedal effort adjuster of a pedal according to an embodiment of the present disclosure.

FIG. 5 is a view showing a definition of angles of a guide inner surface of a guide rail in a pedal effort adjuster of a pedal according to an embodiment of the present disclosure.

Referring to FIG. 5 together with FIGS. 1 to 4, a pedal effort adjuster 100 of a pedal includes a main member 110, a pedal arm 120 rotatably coupled to the main member 110, a piston 130 coupled to one end of the pedal arm 120, a detent spring 140 configured to generate depression force by being compressed by the piston 130, a guide rail 150 coupled to the main member 110 to change a height of the piston 130, a return spring 160 configured to generate depression force in response to operation of the pedal arm 120, and a cover 170 configured to cover the main member 110 wherein angles of the guide rail 150 are defined.

In one specific example, a condition of increasing compression amount of the detent spring 140 is $\theta_3 > 90°$ whereas a condition of decreasing compression amount of the detent spring is $\theta_3 < 90°$.

Where, since $0 \leq \theta_1 \leq 32.52°$, $90° < \theta_1 + \theta_3 < 122.52°$ and therefore $57.48° < \theta_2 < 90°$ so that the larger the $\theta_2$, the longer the stroke of the maximum pedal effort.

According to the present disclosure, the compression amount of the detent spring 140 is calculated using $a = b \cdot \cos C + C \cdot \cos B$ and $b = \sqrt{a^2 + c^2 - 2ac \cdot \cos B}$, as follows:

$$L_4 \sqrt{L_2^2 + L_S^2 - 2 \cdot L_2 \cdot L_S \cdot \cos\theta_2}$$

$$L_5 = \left( \frac{1 - \cos^2\theta_1}{\cos\theta_1 \times \cos\theta_3 + \cos\theta_2} \right) \times L_2$$

Figure 6:
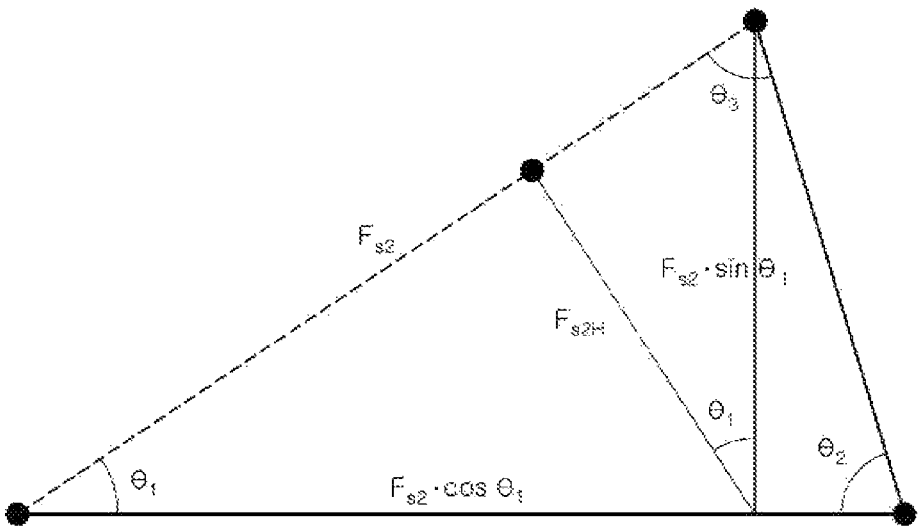
FIG. 6 is a view showing how to calculate pedal effort in a pedal effort adjuster of a pedal according to an embodiment of the present disclosure.

FIG. 6 is a view showing how to calculate pedal effort in a pedal effort adjuster of a pedal according to an embodiment of the present disclosure.

An operating relationship and a control method according to an embodiment of the present disclosure will now be described with reference to FIG. 6 together with FIGS. 1 to 5. When the pedal arm pad 124 provided at one end of the pedal arm 120 is depressed, the pedal arm 120 rotates about the hinge 122 and the piston 130 contacts with the guide rail 150 by reaction force of the detent spring 140 because the detent spring 140 is inserted into one hollow end of the pedal arm 120, and at the same time, pedal effort is generated by the return spring 160.

Operation of the pedal effort adjuster according to this configuration is carried out in such a manner that when the pedal is depressed, a first pedal effort is generated by the return spring 160, and at the same time a second pedal effort is increased and decreased by the detent spring 140 and in turn both the first and second pedal efforts are provided as a clutch pedal effort. The pedal effort generated by the pedal in the pedal effort adjuster of the pedal is calculated using the following equations. $F_{s2H}$ is first calculated according to the following order:

$$F_{s2} = \sqrt{(F_{s2} \cdot \sin\theta_1)^2 + (F_{s2} \cdot \cos\theta_1)^2}$$

$$F_{s2H} = F_{s2} \cdot \sin\theta_1 \cdot \cos\theta_1 + F_{s2} \cdot \cos\theta_1 \cdot \sin\theta_1$$

In addition, since $-F_p \times L_1 = F_{s2H} \times L_4$, pedal effort becomes $$F_p = F_{s2h} \cdot \frac{L_4}{L_2}.$$

where $L_1$ represents a distance from a center of a hinge of the pedal arm to a center of a pad of the pedal arm, $L_3$ represents a distance from a center of a hinge of the pedal arm to a center of a spring $F_{s1}$, $L_4$ represents a distance from a center of a hinge of the pedal arm to a contact portion of the guide inner surface of the guide rail along a pedal stroke, $F_s$ represents a force applied in a direction perpendicular to $L_3$, and $F_{s2}$ represents a force applied in a direction perpendicular to $L_1$.

Figure 7:
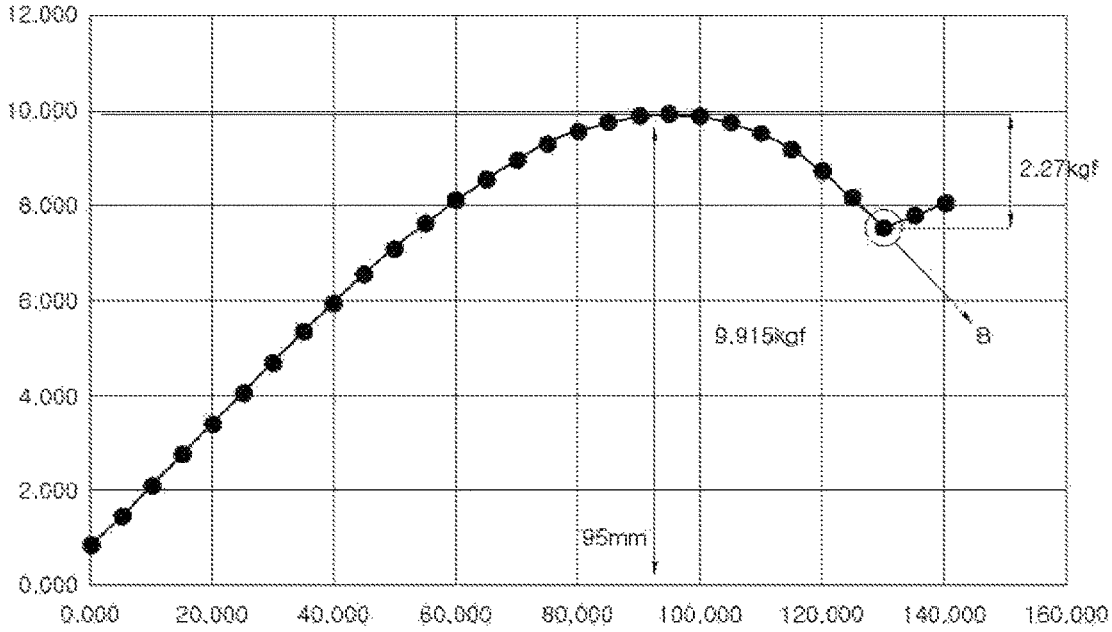
FIG. 7 is a graph showing theoretical pedal effort in a pedal effort adjuster of a pedal according to an embodiment of the present disclosure.
Figure 8:
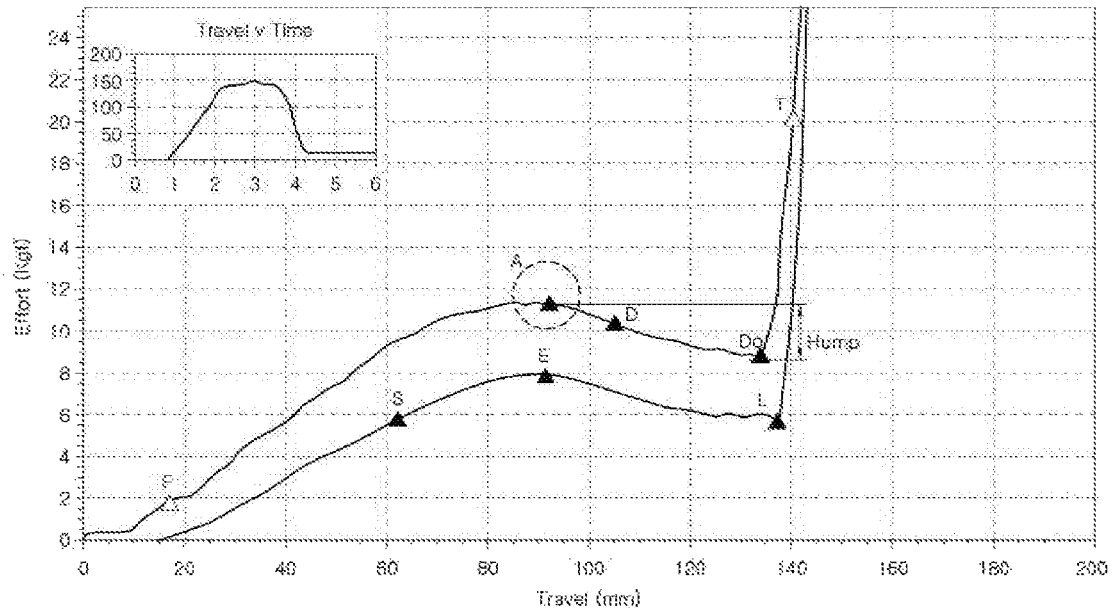
FIG. 8 is a graph showing required pedal effort of a pedal effort adjuster of a pedal according to an embodiment of the present disclosure.

FIG. 7 is a graph showing a theoretical pedal effort in a pedal effort adjuster 100 of a pedal according to an embodiment of the present disclosure, and FIG. 8 is a graph showing a required pedal effort of a pedal effort adjuster 100 of a pedal according to an embodiment of the present disclosure.

Referring to FIGS. 7 and 8, as can be seen first from FIG. 7, a theoretical pedal effort is shown in a form in which it increases in the form of a parabolic curve convex upward and decreases after generating the pedal effort of 9.915 kgf and then an inflection point occurs at a point B. Specifically, the detent spring 140 exhibits pedal effort in the form of a parabolic curve convex upward while the return spring 160 exhibits pedal effort in the form of a straight line upward to the right side and in turn a resulting force of both pedal efforts becomes the theoretical pedal effort.

Next, FIG. 8 shows that the required pedal effort exhibits a graph in the form similar to the theoretical pedal effort wherein the maximum load is generated at a point A and then decreases and in turn hump is generated at a point $D_0$ by a difference between the highest point A and the point $D_0$.

Figure 9:
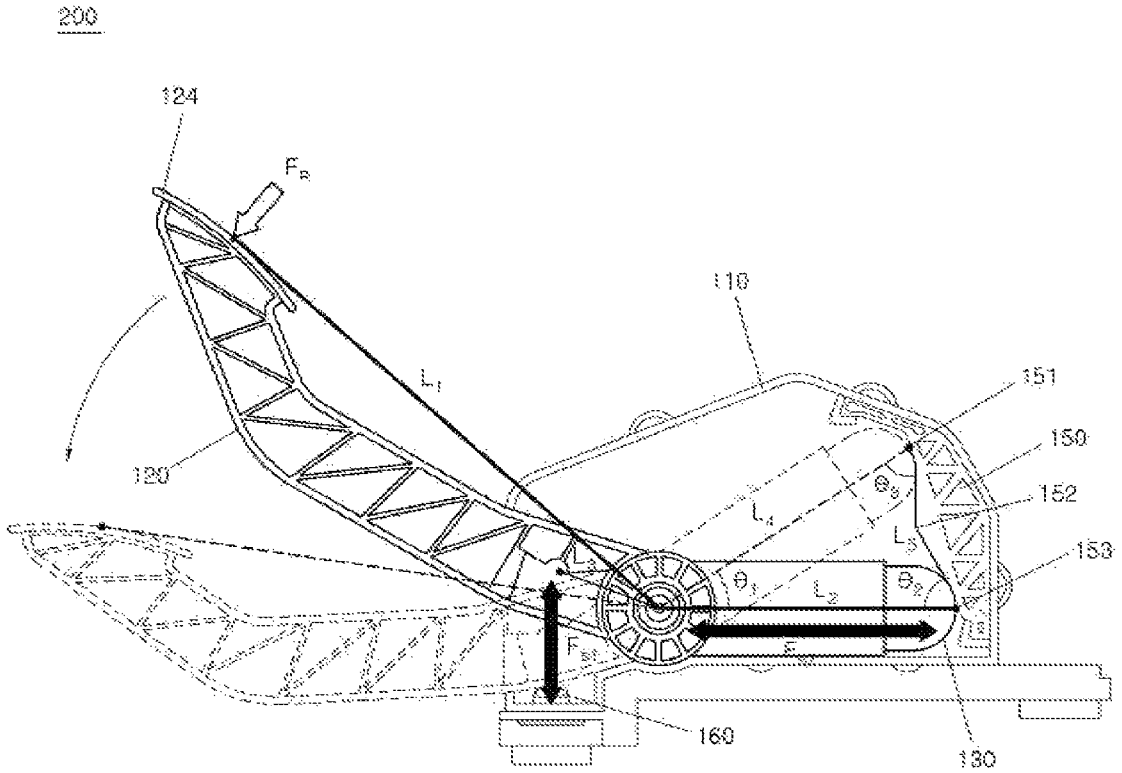
FIG. 9 is a view of a pedal effort adjuster of a pedal according to another embodiment of the present disclosure.

FIG. 9 is a view of a first pedal effort adjuster 200 of a pedal according to another embodiment of the present disclosure.

Referring to FIG. 9, a first pedal effort adjuster 200 includes a main member 110, a pedal arm 120 rotatably coupled to the main member 110, a piston 130 coupled to one end of the pedal arm 120, a detent spring configured to generate depression force by being compressed by the piston 130, a guide rail 150 coupled to the main member 110 to change height of the piston 130, a return spring configured to generate depression force in response to operation of the pedal arm 120, and a cover configured to cover the main member 110.

As can be seen, the first pedal effort adjuster 200 is configured in the same manner as the pedal effort adjuster 100 as described with respect to FIGS. 1 to 8.

Different features in the first pedal effort adjuster 200 are that the inner surface of the guide rail 150 is divided into a plurality of first, second and third guide inner surfaces 151, 152 and 153, and the inner surface to be in contact with the piston 130 is formed in a convex curved shape.

Figure 10:
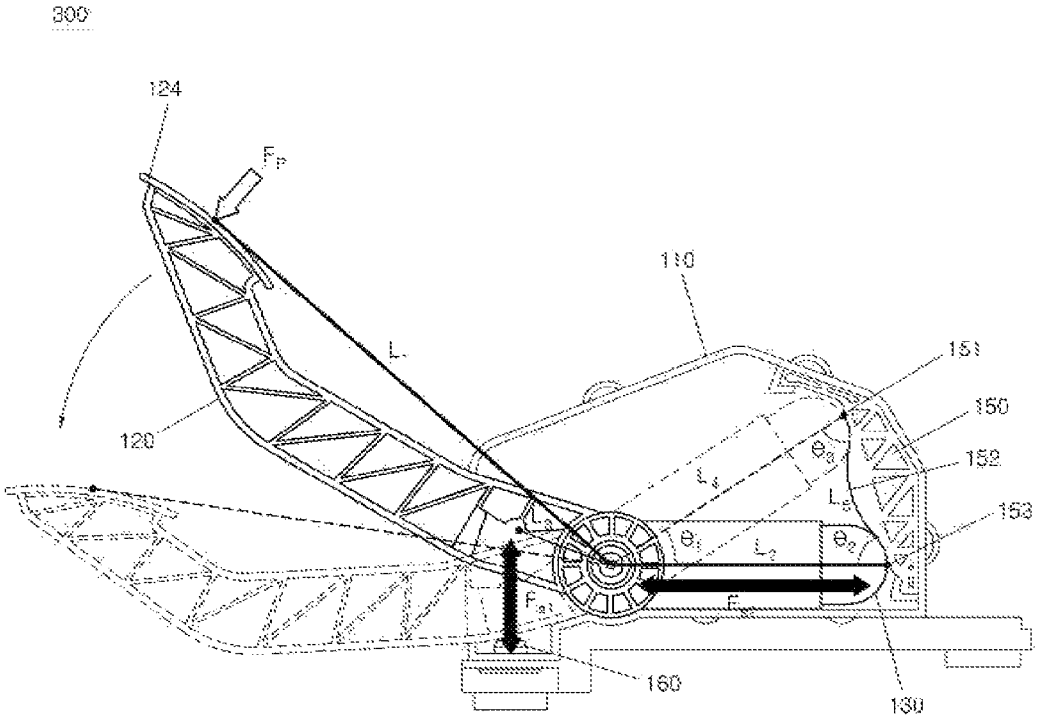
FIG. 10 is a view of a pedal effort adjuster of a pedal according to another embodiment of the present disclosure.

FIG. 10 is a view of a second pedal effort adjuster 300 of a pedal according to another embodiment of the present disclosure.

Referring to FIG. 10, a second pedal effort adjuster 300 includes a main member 110, a pedal arm 120 rotatably coupled to the main member 110, a piston 130 coupled to one end of the pedal arm 120, a detent spring configured to generate depression force by being compressed by the piston 130, a guide rail 150 coupled to the main member 110 to change a height of the piston 130, a return spring configured to generate depression force in response to operation of the pedal arm 120, and a cover configured to cover the main member 110.

As can be seen, the second pedal effort adjuster 300 is configured in the same manner as the pedal effort adjuster 100 as described with respect to FIGS. 1 to 8.

Different features in the second pedal effort adjuster 300 are that the inner surface of the guide rail 150 is divided into a plurality of first, second and third guide inner surfaces 151, 152 and 153, and the inner surface to be in contact with the piston 130 is formed in a convex circular arc shape.

As a result, in the pedal according to the present disclosure, since the pedal effort adjuster 100, 200, or 300 is configured in such a manner that the guide inner surface of the guide rail is assembled in the main member, it is possible to meet various requirements of drivers by simply replacing the guide inner surface of the guide rail, maneuverability can be further enhanced through increase of both pedal effort and hump by simply increasing the peak of the guide inner surface of the guide rail, and pedal effort can be implemented with the minimum layout by virtue of a simple structure so that process-ability and economic efficiency can be enhanced.

It will be understood by those skilled in the art that the present disclosure may be embodied in other specific forms without departing from the spirit or essential characteristics thereof. Therefore, it should be understood that the embodiments as described above are merely selected among various possible examples and provided as the most preferred embodiments of the present disclosure in order for those skilled in the art to understand the present disclosure and therefore the technical spirit of the present disclosure is not necessarily restricted or limited only by the embodiments provided and that various changes, additions and modifications may be made without departing from the spirit of the present disclosure and other embodiments equivalent thereto are possible. The scope of the present disclosure is defined by the appended claims rather than by the foregoing description and all changes or modifications derived from the meaning and scope of the claims and the equivalents thereof should be construed to be covered by the scope of the present disclosure. The terms and words used in the specification and claims are defined on the basis of the principle that the inventor can define the concept of a term appropriately in order to describe his/her own disclosure in the best way and should not be construed as only their ordinary or dictionary sense. In addition, it is natural that the order of configurations described in the foregoing description is not necessarily required to be performed in a time-series order and that although the order of carrying out each of the configurations or steps is changed, if this change fulfills the gist of the present disclosure, it will fall within the scope of the present disclosure.

What is claimed is:

1. A pedal, comprising:

a pedal effort adjuster configured to generate pedal effort in response to an increase in stroke of a pedal arm, wherein the pedal effort adjuster further comprises:

a detent spring for generating the pedal effort by load of the detent spring that is decreased after being increased in response to a change in reaction force caused by the increase in stroke;

a return spring for generating the pedal effort by load of the return spring that is increased by maintaining reaction force caused by the increase in stroke;

a piston coupled to one end of the pedal arm to compress the detent spring; and a main member configured such that a guide inner surface of a guide rail for changing a height of the piston is coupled thereto and the main member is covered and concealed with a cover, wherein the main member and the guide rail are connected to each other via coupling protrusions.

2. The pedal according to claim 1, wherein the reaction force of the detent spring is changed by the piston.

3. The pedal according to claim 2, wherein the detent spring is installed within the pedal arm.

4. The pedal according to claim 2, wherein the piston has a round shape at its outside end.

5. The pedal according to claim 4, wherein the piston is configured to be inserted into the one end of the pedal arm and coupled thereto in a protruding state.

6. The pedal according to claim 2, wherein the piston contacts with the guide inner surface of the guide rail.

7. The pedal according to claim 6, wherein the guide inner surface of the guide rail divides a contact movement path of the piston into a plurality of paths to make the change in the reaction force.

8. The pedal according to claim 7, wherein the guide inner surface of the guide rail is configured such that the contact movement path is formed in a straight line.

9. The pedal according to claim 7, wherein the guide inner surface of the guide rail is configured such that the contact movement path is formed in a curved form.

10. The pedal according to claim 7, wherein the guide inner surface of the guide rail is configured such that the contact movement path is formed in a circular arc shape.

11. The pedal according to claim 1, wherein the pedal arm is rotatably coupled to the main member.

12. The pedal according to claim 11, wherein the main member and the guide rail are directly connected to each other.

13. The pedal according to claim 1, wherein the main member and the cover are connected to each other via protrusions.

* * * * *